United States Patent [19]

Jorgensen

[11] 4,345,575

[45] Aug. 24, 1982

[54] IGNITION SYSTEM WITH POWER BOOSTING ARRANGEMENT

[76] Inventor: Adam A. Jorgensen, 1911 NW. 36 St., Oakland Park, Fla. 33309

[21] Appl. No.: 265,669

[22] Filed: May 20, 1981

[51] Int. Cl.[3] ..... F02P 3/06; F02P 15/00

[52] U.S. Cl. ..... 123/598; 123/620; 123/656

[58] Field of Search ..... 123/596, 598, 620, 640, 123/655, 656

[56] References Cited

U.S. PATENT DOCUMENTS

| | | | |
|---|---|---|---|
| 3,919,993 | 11/1975 | Neuman | 123/620 |
| 4,122,816 | 10/1978 | Fitzgerald et al. | 123/620 X |
| 4,136,301 | 1/1979 | Shimojo et al. | 123/620 X |
| 4,223,656 | 9/1980 | Hamley | 123/620 X |
| 4,269,161 | 5/1981 | Simmons | 123/620 |
| 4,301,782 | 11/1981 | Wainwright | 123/620 |

FOREIGN PATENT DOCUMENTS

| | | | |
|---|---|---|---|
| 2268169 | 11/1975 | France | 123/620 |

*Primary Examiner*—Tony M. Argenbright
*Attorney, Agent, or Firm*—Oltman & Flynn

[57] ABSTRACT

An ignition system for internal combustion engines employing two coordinated power sources which, together, provide a spark of much increased intensity and with extended duration. The first of the coordinated power sources is generally similar to the conventional ignition system employing an ignition coil with a primary and secondary winding, the secondary winding generating a high voltage impulse of very high voltage and low current value and of short duration. The second power source is a storage capacitor which is connected to a direct current power supply which, through a limiting resistor, charges the capacitor to a voltage which is too low to initiate a spark, but high enough to sustain an arc of a controlled high current value for increased duration, once a preliminary spark has been generated across the spark gap at the moment an energizing current in the primary winding of the ignition coil is interrupted. The two coordinated power sources may be connected to the spark plug in parallel connection through rectifiers, which provide separation between the power sources, or the two power sources may be connected with the spark plug in series connection again using rectifiers to separate them. Multiple sequentially firing spark plugs as used in engines with multiple cylinders may be driven by the present invention by incorporating a distributor which sequentially distributes either the preliminary spark or the combined sparking energy to the spark plugs.

8 Claims, 7 Drawing Figures

IGNITION SYSTEM WITH POWER BOOSTING ARRANGEMENT

BACKGROUND OF THE INVENTION

Internal combustion engines with high voltage electrical ignition are usually provided with an ignition coil which provides the high voltage pulses that are needed to produce an electrical spark across the spark gap of a spark plug which, in turn, ignites the compressed fuel-air mixture in the combustion chamber of each cylinder at the start of the power cycle. There are essentially two (2) types of generators for such high voltage pulses, namely the conventional automotive ignition coil which has a primary circuit energized by the engine's low voltage primary power. Another generator for such high voltage pulses is the so-called magneto, which has a rotating armature revolving in a magnetic field, driven by the engine, and which is energized directly from the engine's camshaft or driveshaft. These types of ignition systems have been used successfully for many years, and are described in text books on automotive engineering. One such book is Basic Ignition and Electrical Systems by R. E. Petersen, published by Petersen Publishing Co. and has Library of Congress Catalog Card Number 73-79968.

In those conventional systems using ignition coils or magnetos, the high voltage pulses are generated in a high impedance secondary winding consisting of many turns of fine wire having a resistance of 5 to 10 kilo ohms which produces a high voltage pulse of typically 10 to 15 thousand volts at the instant a current flowing in a primary winding magnetically coupled with the secondary winding is abruptly interrupted. The interruption of the primary current is often done by a set of mechanical contact points, the so-called breaker points which are opened by mechanical cams at precisely timed instants during the rotation of the engine. During recent years, many so-called electronic ignition systems have been developed where the interruption of the primary current is performed by solid state circuit components in order to attain longer life and improved engine performance.

In recent years, there has been increased demand for improvement in engine performance, in regard to fuel efficiency and in regard to reduction of unwanted air-polluting exhaust gas emissions.

In order to attain such improved engine performance, it is desirable to operate engines at a lower fuel to air ratio, a so-called leaner mixture. Ideally, an engine should be operated at a so-called stoichiometric ratio of fuel to air, at which ratio total combustion of the fuel will be attained. Such a ratio, however, is quite lean and is more difficult to ignite and has a decreased flame front velocity compared with the richer conventional fuel-air mixture.

For the above reasons, engine designers have aimed at developing ignition systems that generate more powerful sparks of longer duration than the spark produced by the conventional secondary winding of the ignition coil which, due to its high resistance and high inductance, can only produce a spark of limited intensity and duration. The extended duration of the spark is desirable because combustion chambers are often designed such that a strong swirling motion is imparted to the fuel-air mixture in the combustion chamber, which provides for a more extended contact with the sustained arc of the spark gap.

Many inventors have worked at devising ignition systems that provide such improved spark characteristics as described above. Some of those are listed in the references. One reference in particular, is U.S. Pat. No. 3,919,993, issued Nov. 18, 1975 to J. G. Neuman. That referenced patent describes an ignition system where the spark is generated and sustained by means of two generally parallel connected coordinated power sources such that one of the power sources is very high voltage secondary winding of an ignition coil of generally conventional nature which produces an initial spark across the spark gap at a voltage of sufficient value to safely bridge to spark gap but of a relatively low intensity coordinated with the spark from another ignition coil having a secondary winding which is constructed so as to generate a voltage inpulse of much lower voltae but of a much higher current value. The impulse from the latter ignition coil is timed by appropriate means to happen at a time slightly later than the first initial impulse in a precisely controlled timing sequence.

The present invention discloses an ignition system constructed so as to provide a spark of much increased intensity and increased duration, and such that both the intensity and the duration of the spark can be controlled within wide limits by judicial choice of the controlling components, using two coordinated power sources such that one power source is the secondary winding of a generally conventional ignition coil which produces an initial impulse of voltage high enough to bridge the spark gap with a spark which is generally of low intensity and of short duration coordinated with another power source which will sustain the spark in the form of an electrical arc of high intensity as determined by current limiting circuit elements, and of a duration which is determined by the product of the resistance of the current limiting circuit element and the capacitance of the storage capacitor. Means are provided as required, to ensure that the arc is extinguished after the elapse of such time that it is no longer needed to sustain the combustion in the combustion chamber.

The present invention shows how the two coordinated power sources described above, may be either parallel or series connected.

It is, therefore, a major object of the present invention to provide an improved ignition system for internal combustion engines.

It is an additional object of the present invention to provide an improved ignition system for internal combustion engines which combines a high voltage inductively generated initial impulse of short duration and low current value with a capacitive power source of relatively low voltage, but high current value such as to produce an electric arc of high intensity and extended duration.

It is an additional object of the present invention to provide an improved ignition system for internal combustion engines which combines a high voltage inductively generated initial impulse of short duration and low current value with a capacitive power source of relatively low voltage, but of a high current value such that the two power sources are coordinated in generally parallel connection utilizing high voltage rectifiers such that the high current from the capacitive power souce bypasses the spark distributor.

It is still another object of the present invention to provide an improved ignition system for internal combustion engines which combines a high voltage inductively generated initial impulse of short duration and low current value with a capacitive power source of relatively low voltage, but of a high current value such that the two power sources are combined in generally series connection with at least one high voltage rectifier separating the two power sources.

It is a further object of the present invention to provide an improved ignition system that is generally of simple construction and which provides a spark of such intensity that fouling conditions around the spark gap electrodes will tend to be burned away and in this way contribute to a more reliable ignition system.

BRIEF DESCRIPTION OF DRAWINGS

For better understanding of the invention, the following drawings are referred to.

The reference numerals shown on all the drawings correspond to each other, so that in different embodiments, the same numeral always represents the same element.

DESCRIPTION OF PREFERRED EMBODIMENTS

Figure 5A:
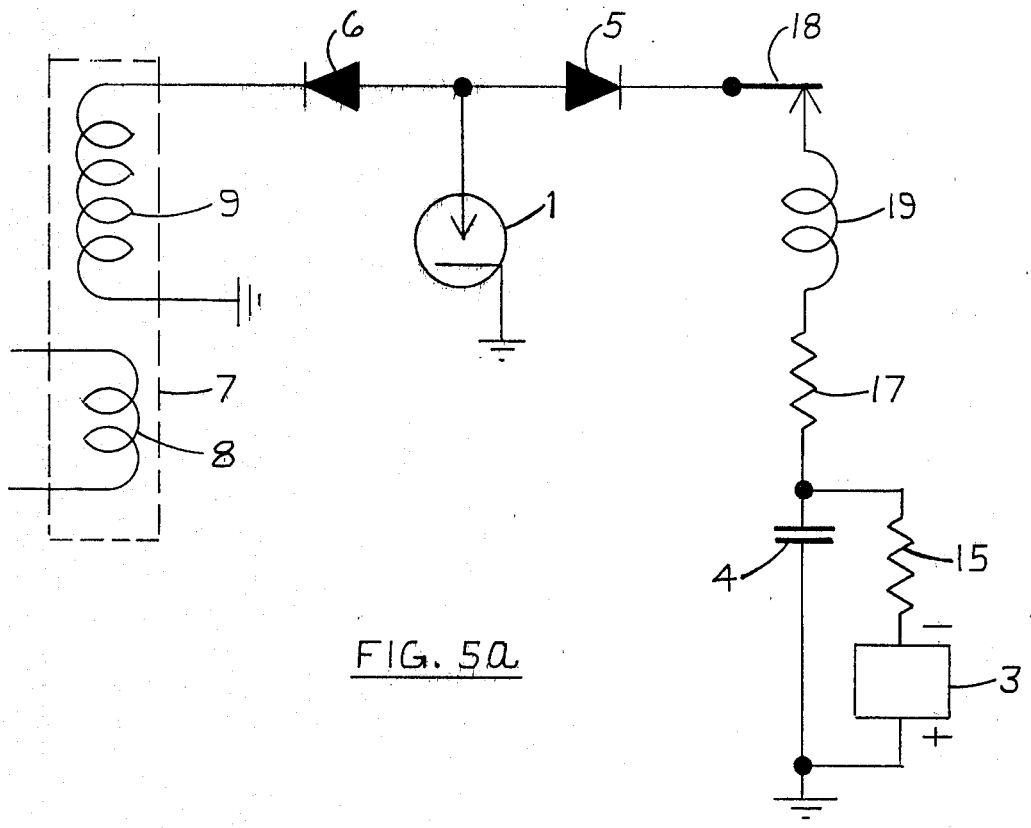
FIGS. 5*a* and *b* show simplified circuit diagrams of the two major embodiments of the present invention with all circuit elements not needed for the understanding of the basic invention deleted, and more particularly, such that FIG. 5*a* shows the embodiment employing two generally parallel connected power sources.

Referring to FIG. 5*a* which shows, in simplified form, the basic elements of the ignition system of the present invention, and more particularly, the embodiment which employs two coordinated, generally parallel, connected power sources. The first power source is shown generally at 7, which shows two windings of an ignition coil having a primary low resistance winding 8, consisting of relatively few turns of heavy wire and a secondary high voltage winding 9, consisting of many turns of thin wire wound concentrically on a magnetic core, and where the two windings have a turns ratio such that a high voltage impulse of typically 10–15 thousand volts is generated between the terminals of that winding when an energizing current in the primary winding is abruptly interrupted. Of the two terminals of the high voltage winding, one terminal, the low voltage terminal, is shown grounded in this simplified diagram, but as shown in other diagrams, this terminal is not always grounded, but is always at a lower potential than the high voltage terminal, which, at the instant of the interruption of the current in the primary winding, reaches a high voltage potential which strikes a spark across the spark gap of the spark plug 1. This spark striking potential which is of negative polarity, is connected to the spark plug through a rectifier 6. Negative potential is used most commonly in modern ignition systems, although the polarity whether negative or positive is immaterial for the present invention.

Since winding 9 has high resistance typically, 5–10 thousand ohms and high selfinductance, the current in the resulting spark is of a low value, typically a few milliamperes, and the duration of the spark is typically a small fraction of a millisecond. Thus, the initial spark is not well suited for igniting a lean fuel-air mixture due to its low intensity and short duration. However, the initial spark provides a path of conductive ionized gas molecules across the spark gap. This conductive path, as soon as it is established, provides also a path of current flow for the second power source consisting of storage capacitor 4, which is charged to a potential, typically 2–4 thousand volts, from direct current power supply 3 through first limiting resistor 15. As a result an arc of high intensity, sustained by the energy stored in the capacitor is established immediately following the initial spark. The current in the arc is limited by second limiting resistor 17, and decays exponentially as the capacitor discharges, until the current value is too low to sustain the arc.

The voltage generated by the power supply 3 is of lower potential than that required to initiate a spark, but high enough to sustain the arc at a high current value for a predetermined length of time. The electrical parameters of the arc, its current value and duration and their relationship to the circuit elements will be shown later in this description.

As described above, the two power sources, namely the high voltage source, winding 9, and the high current source, the storage capacitor 4, are in parallel connection through the two rectifiers 6 and 5, which serve to provide separation between them. Rectifier 5 prevents the current for the initial spark from high resistance winding 9 from being dissipated in the low impedance circuit consisting of resistor 17 and storage capacitor 4. Similarly, rectifier 6 prevents the storage capacitor 4 from being discharged through winding 9 during the intervals between sparks.

During the discharge of the capacitor 4, the voltage across the capacitor terminals decreases at an exponential rate as a function of the elapsed time, the value of the capacitor and the value of second limiting resistor 17. The product of the resistor value in ohms and the capacitor value in Farads is called the time constant of the discharge circuit which has the dimension of seconds. After the elapse of a time which is equal to one time constant, the current and voltage will have decayed to a value of $\epsilon^{-1}=0.368$ of the original value. The voltage and current will decay in accordance with the function:

$$e_c(t)=E/\{\epsilon^{(t/R17C)}\},$$

where $e_c$ = *voltage across capacitor terminal as a function of t* t = elapsed time from initial spark in seconds

E = the initial voltage stored on the capacitor, which also equals the open circuit voltage of power supply 3

$\epsilon$ = base of the natural logarithm = 2.718

R17 = the resistance of second limiting resistor 17 in ohms c = capacitance of storage capacitor 4 in farads.

While the capacitor normally discharges rapidly while expending its stored energy partly in the arc and partly in the resistances in the circuit, it is also being charged by the power supply 3 through first limiting resistor 15. The rate of charging is exponential as expressed by the function:

$$e_c(t) = E(1-(1/\epsilon)^{(t/R15C)})$$

In an experimental ignition system which was found to work well, the following values were used: R15, 1000 ohms, R17, 50 ohms, capacitor 4,0.1 micro farad; power supply 3,300 volts.

The rectifiers 5 and 6 were each constructed from four series connected Motorola type MR250-5 rectifier diodes. The direct current power supply 3 may be of the dc-dc converter type obtaining its primary power from the engine's low voltage power system. Such converters are well known, and widely used for many applications.

Two additional circuit elements, 18 and 19, may be included with the system. Circuit element 18 is a current disconnect element, which is introduced in the current loop for the high current source. In one preferred embodiment of the present invention, this element is a mechanical switch with heavy duty metallic contacts and operated in timed relationship with the engine by rotating a cam, such that the contacts are opened at some predetermined time or angle of rotation after the initial spark has been struck, and such that the discharge current from storage capacitor 4 is interrupted, and the sustained arc is extinguished at a time earlier than the time at which the arc would have been extinguished, due to the gradual discharge of capacitor 4. At the further rotation of the cam, the contacts of 18 will again be closed at a time immediately prior to the next initial spark.

The current disconnect element 18 may, at the option of the designer, serve to shorten the duration of the sustained arc, and further, to ensure that the storage capacitor 4 is fully recharged at the beginning of the next initial spark in case spark plug fouling should have created a current leakage across the spark gap which would prevent capacitor 4 from being recharged to the full potential of power supply 3. In this manner, circuit element 18 will serve to increase the ignition reliability.

It should be understood that the current disconnect device 18 need not be of mechanical construction, but may be designed using solid state type current controlling elements and that the rotating cam drive may be replaced with appropriate electronic timing circuit elements that operate to disconnect the current, sustaining the arc after a predetermined lapse of time after the initial spark, and such that the current source is again connected at the time the initial spark is struck.

Circuit element 19 is an inductor, disposed in the current loop in series with second limiting resistor 17. This inductor, when included in the circuit, will operate to slow down the otherwise very rapid increase of current in the current loop. Further, the inductor will coact with the capacitor 4, so that they, together, operate as a series resonant circuit that, depending upon the values of the inductor, the capacitor and limiting resistor 17, will create a current pulse generally of the form of a damped single sinusoidal halfwave of current in the loop. The duration of the halfwave will be $$\Delta = \sqrt{LC} \text{ Sec.},$$

where

L = selfinductance of the inductor 19 in henrys

C = capacitance of capacitor 4 in farads.

If the series resonant circuit is less than critically damped, the rectifier 5 will prevent the halfwave of current from continuing into the second halfwave, and in this way, at the end of the halfwave, the arc will be extinguished. The presence of the inductor 19 will provide a more efficient transfer of energy from the storage capacitor to the arc, since less energy will be lost in the resistor 17.

Figure 5B:
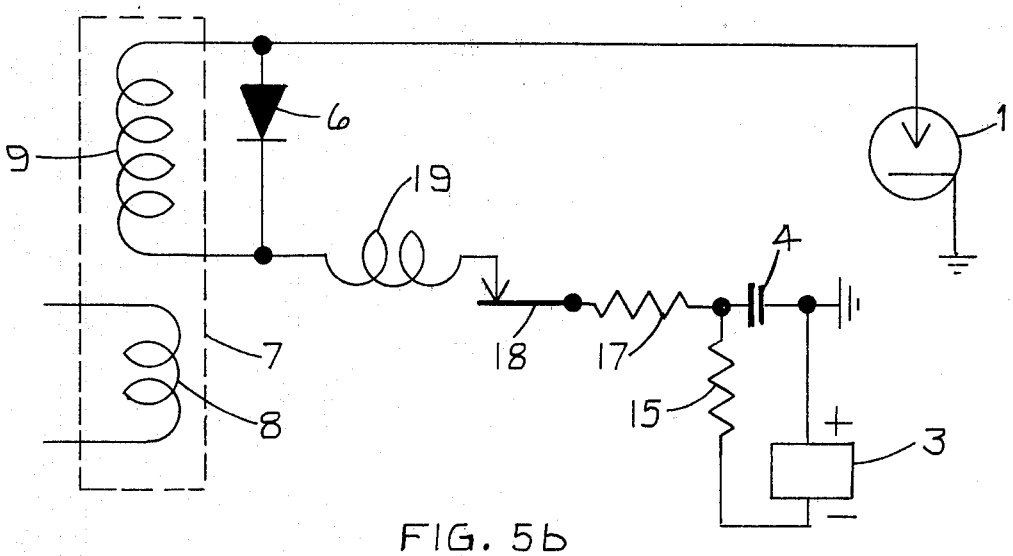
FIG. 5*b* shows the embodiment employing two generally series connected power sources.

FIG. 5*b* is a simplified drawing of another preferred embodiment of the present invention. It contains the same elements as shown in FIG. 5*a*, but in this case, the two coordinated power sources are combined in series connection. The method of operation is similar. Upon interruption of an energizing current in winding 8 of ignition coil 7, secondary winding 9 generates a pluse of high voltage, but low current which in turn creates an initial spark of low intensity and short duration across the spark gap of spark plug 1. The initial spark creates a conducting path of ionized gas across the spark gap. This path enables the high current source consisting of storage capacitor 4, which is charged to a voltage which is too low to initiate a spark, but high enough to generate and sustain an arc of high intensity and extended duration in the path established by the initial spark.

A rectifier 6 is connected across the terminals of high voltage winding 9, such that the high current, once the arc is established, may bypass the high impedance of winding 9. The storage capacitor 4 is charged by a direct current power supply 3 through first limiting resistor 15, and the capacitor discharges through second limiting resistor 17. The two series connected power sources are connected in mutually aiding connection and such that a negative potential is applied to the spark plug.

The two optional circuit elements, current disconnect element 18 and resonating inductor 19, serve the same functions as they do in FIG. 5*a*, and to avoid prolixity, shall not be explained again.

Figure 6:
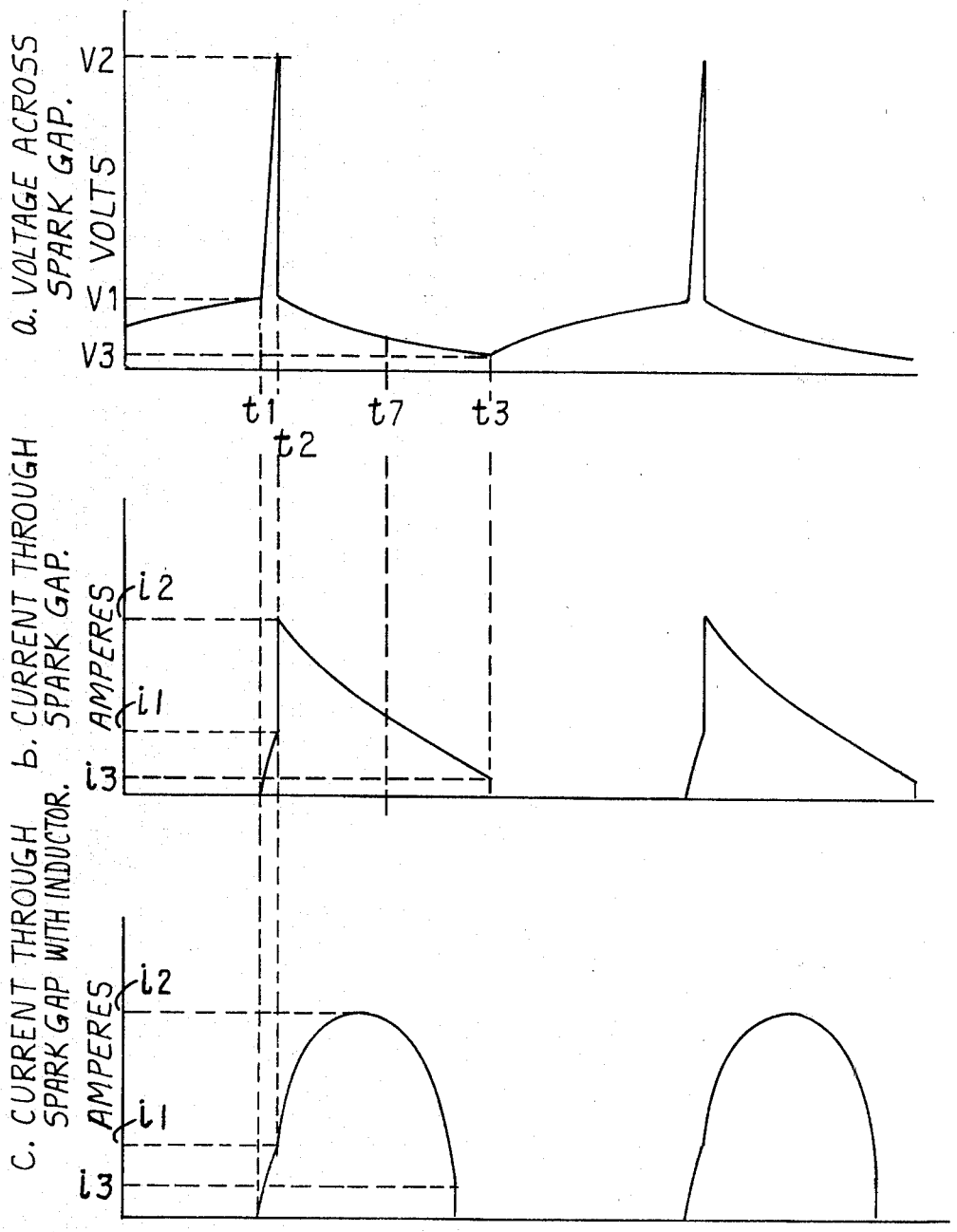
FIG. 6 shows a graphical representation of the voltage, and current versus time across the spark gap.

FIG. 6*a*, *b* and *c*, which applies to both FIG. 5*a* and 5*b*, shows in graphic form, as a function of time, the voltage and current across the spark gap. FIG. 6*a* shows voltage accross the spark gap. Before time $t_1$, the dc voltage is that of the storage capacitor shown on the vertical unit as $V_1$. At time $t_1$ the high voltage creating the initial spark commences and reaches a peak voltage $V_2$, at which time the initial spark is created. At the time $t_2$ the high current power source starts the sustained arc. Between $t_2$ and $t_3$ the storage capacitor discharges its energy, and the voltage decays to the voltage $V_3$, at which point the voltage is too low to sustain the arc, which is then extinguished. The corresponding current-time relationships are shown in FIG. 6*b*. Before $t_1$ no current flows. Between times $t_1$ and $t_2$, the current rises to the relatively low value of $i_1$ and rises sharply to the high value $i_2$ at time $t_2$, when the high current power source starts to feed the sustained arc. The current decays exponentially between times $t_2$ and $t_3$, and drops to zero at time $t_3$.

The action of the current disconnect element 18, if included with the circuit, may take place at times $t_1$ and $t_7$. The element 18 closes the circuit at or immediately prior to time $t_1$, such that the voltage would be at zero value prior to $t_1$, and it would open the circuit at $t_7$ at which time both the voltage on FIG. 6*a* and the current on FIG. 6*b* would drop to zero.

FIG. 6*c* shows the current through the spark gap with the resonating inductor 19 included in the circuit. The circuit is less than critically damped, and a half-wave is found between the times $t_2$ and $t_7$.

Having above described, in abbreviated form, the method of operation of the present invention in two basic preferred embodiments, I shall proceed to describe in greater detail various preferred embodiments based on the above two basic embodiments.

Figure 1:
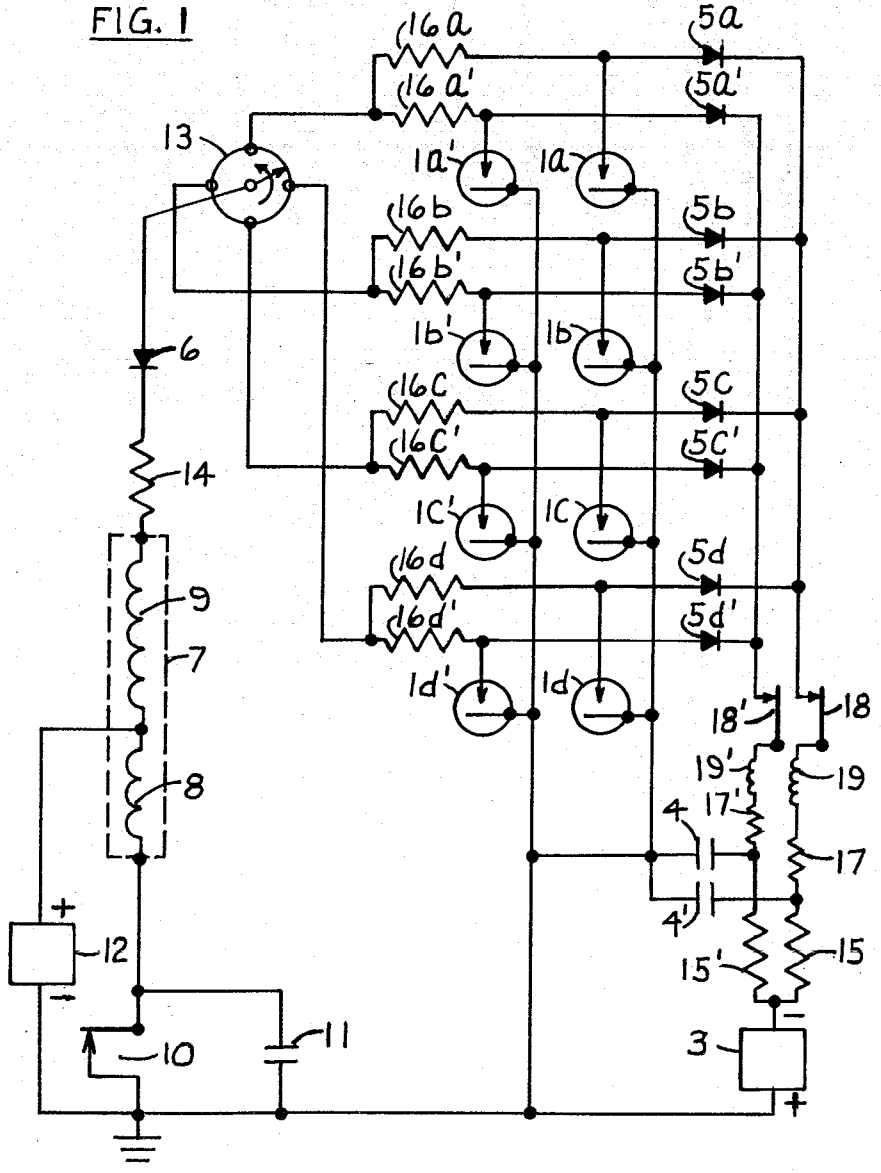
FIG. 1 is a circuit diagram of the engine ignition system described in the present invention, and more particularly, the embodiment employing two coordinated generally parallel connected power sources.

FIG. 1 shows the present invention in accordance with the first preferred embodiment described above in FIG. 5*a*, expanded to include multiple combustion chambers with a multiple cylinder engine, each combustion chamber equipped with at least one spark plug.

The ignition coil 7 has a primary winding 8 and a secondary winding 9. The primary winding 8 is connected to an energizing circuit consisting of low voltage power source 12, which may be the engine's battery or any suitable power source and an interrupter contact 10. Interrupter 10 is connected to the engine's drive shaft through suitable mechanical means so that 10 is opened in a fixed timed relationship with the engine rotation at the instant a spark is to be struck. Capacitor 11 serves to resonate with the self-inductance of primary winding 8, so that a high voltage is generated in winding 9 when the interrupter contacts 10 are opened. The high voltage winding 9 is connected to a plurality of sets of spark plugs 1*a*, 1*a*′ through 1*d* and 1*d*′, through resistor 14, which represents the combined resistance of winding 9 and the lumped and distributed resistances of the connection to the distributor 13. Distributor 13 consists of a common rotating contact driven in a fixed rotational relationship with the engine's drive shaft, such that each successive high voltage impulse is connected in sequence to each set of spark plugs at the time a spark is to be struck in each spark plug.

All the circuit elements combining to generate the initial spark and are described above are well known and described in the art, and may take various forms while all essentially performing the same function. For the purpose of the present invention, a rectifier 6 has been added in the connection from high voltage winding 9 to distributor 13. Rectifier 6 is a high voltage rectifier described above in connection with FIG. 5*a*. This rectifier prevents the charge on the storage capacitors 4 and 4′ from being dissipated through the ignition coil 7 between successive sparks. FIG. 1 illustrates an engine with four (4) cylinders. For the purpose of the present invention, the number of cylinders and the number of spark plugs associated with each cylinder is immaterial. In the specific case where more than one spark plug is used with each cylinder, a dividing network consisting of resistors 16*a* through 16*d* and resistors 16*a*′ through 16*d*′ are required to ensure that both spark plugs in each set of spark plugs fire simultaneously at the time an initial spark is to be struck. If no such resistors were provided, a minute difference between spark gaps of a set of spark plugs could cause only one of the spark plugs to fire.

Each spark plug is connected through rectifiers 5*a* through 5*d* and 5*a*′ to 5*d*′ to storage capacitors 4 and 4′, through limiting resistors 17 and 17′. Those storage capacitors are connected to power supply 3 through first limiting resistors 15 and 15′. The above circuit elements 4, 4′, 15, 15′, 17, 17′ cooperate in a manner similar to that described under FIG. 5*a* as the high current source, except their numbers are increased in order to accommodate a multiple cylinder engine and where each cylinder may be equipped optionally with more than one spark plug. The high voltage power source consisting of elements 6, 7, 10, 11, 12, 13 and 14 generates sequentially in each set of spark plugs an inital spark. The high current power source subsequently generates a high current sustained arc of high intensity and extended duration in the corresponding spark plugs.

Figure 2:
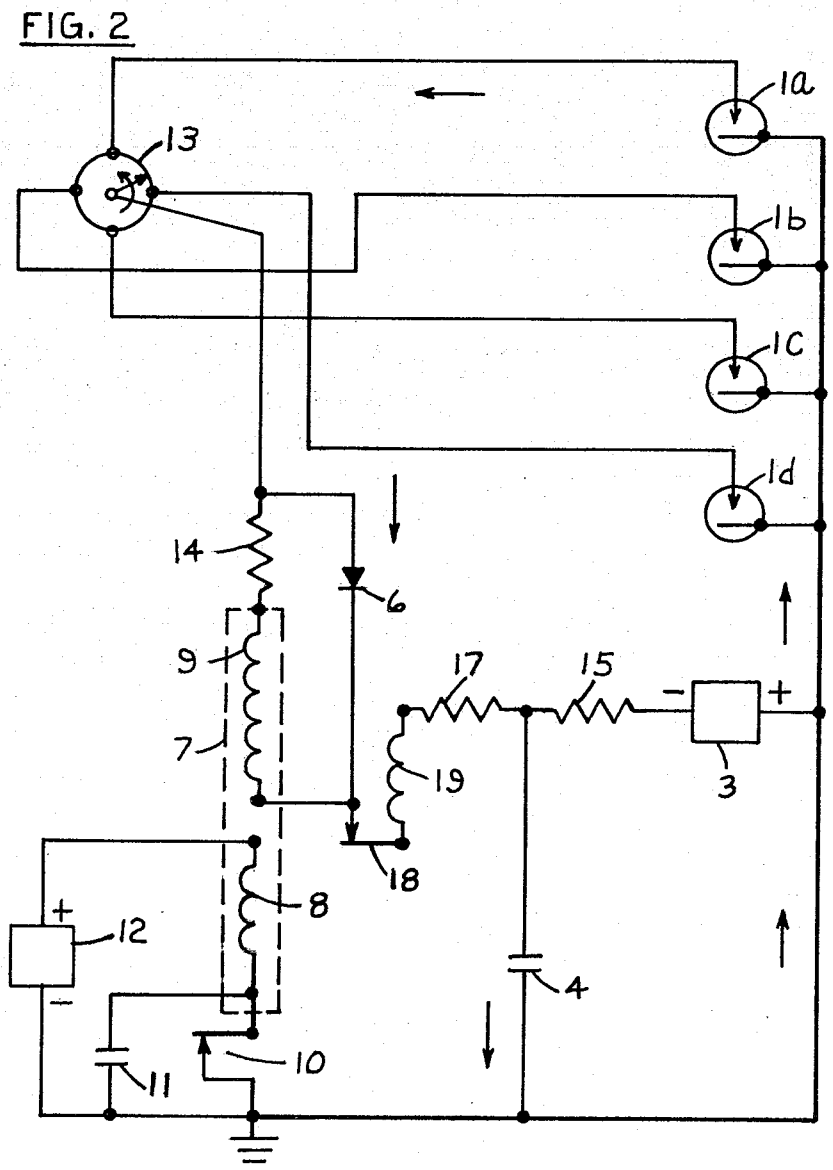
FIG. 2 is a circuit diagram of the engine ignition system described in the present invention, and more particularly, the embodiment employing two coordinated series connected power sources.

FIG. 2 shows the present invention in accordance with the second preferred embodiment described above under FIG. 5*b*, but expanded to a multicylinder engine with spark plugs 1*a* through 1*d*. The second preferred embodiment of the present invention employs two coordinated power sources combined in series connection. As in FIG. 1, elements 7, 8, 9, 10, 11, 12 and 14 in combination from the high voltage power source. For the purpose of the present invention, rectifier 6 is added so that the high current from the high current source consisting of elements 3, 4, 15, 17, 18 and 19 is not impeded during discharges by the high impedance of winding 9 and resistor 14. As in FIG. 5*b*, the power sources are in mutually aiding connection, presenting a negative potential to the spark plugs. Since a plurality of spark plugs are required, a distributor 13 has been added as a new element. The distributor is described under FIG. 1, and operates, in the present embodiment, in a similar manner.

The ignition coil 7, in this embodiment, is different from the iginition coil 7 used in FIG. 1, in that the primary winding 8 is not connected with the secondary winding 9. This difference is necessary, in order to prevent the high current power source from discharging its energy through the primary winding 8. The optional current disconnect element 18 and the optional resonating inductor 19 operate in a manner identical to that described under FIGS. 5*a* and 5*b*.

Figure 3:
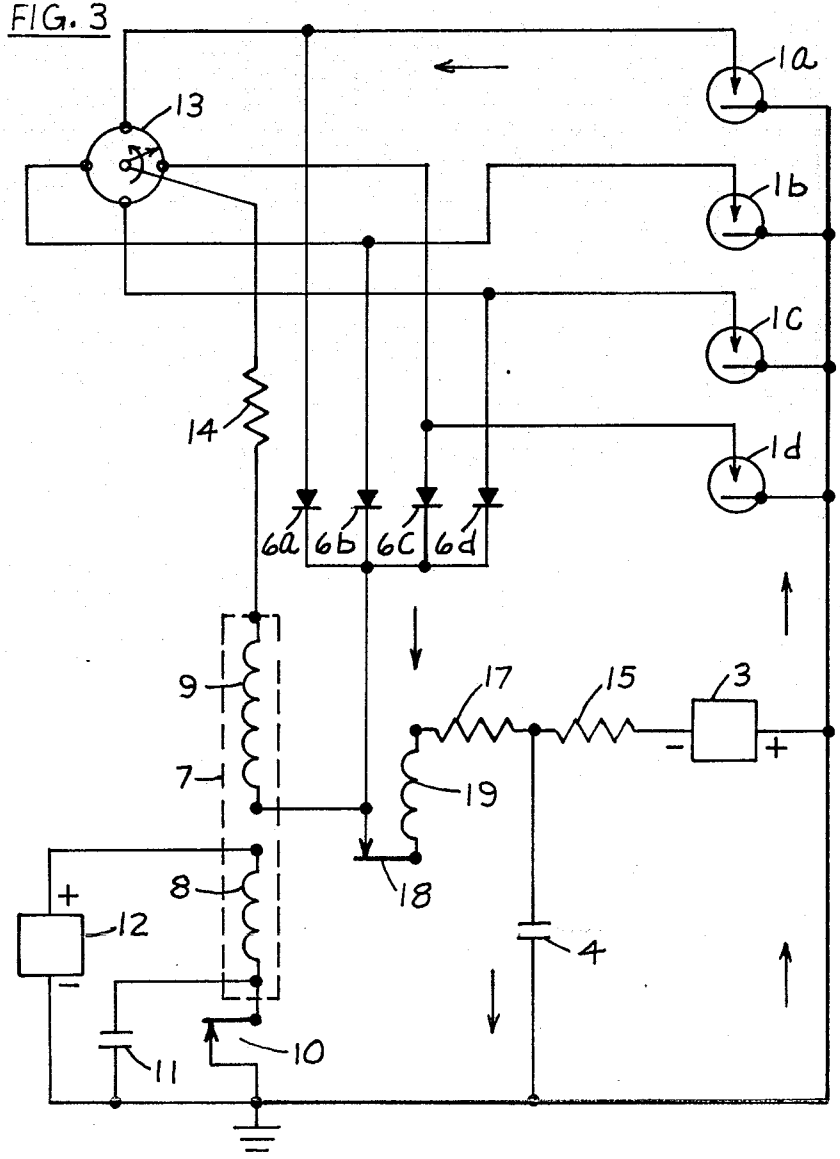
FIG. 3 is a circuit diagram of the engine ignition system described in the present invention, and more particularly, an embodiment employing two generally series connected power sources, further employing separate rectifiers for bypassing the distributor contacts.

FIG. 3 shows another preferred embodiment of the present invention in accordance with the second preferred embodiment described generally under FIG. 5*b* and in more detail under FIG. 2, and which again employs two coordinated series connected power sources. FIG. 3 shows a plurality of rectifiers 6*a* through 6*d*. One rectifier is provided for each spark plug in parallel connection with secondary winding 9, resistor 14 and distributor 13, such that the high current from the high current source bypasses also the distributor. In this case, the voltage drop across the distributor does not reduce the intensity of the sustained arc, and the distributor contacts may be constructed for a current rating lower than that required to pass the entire current from the high current source.

Figure 4:
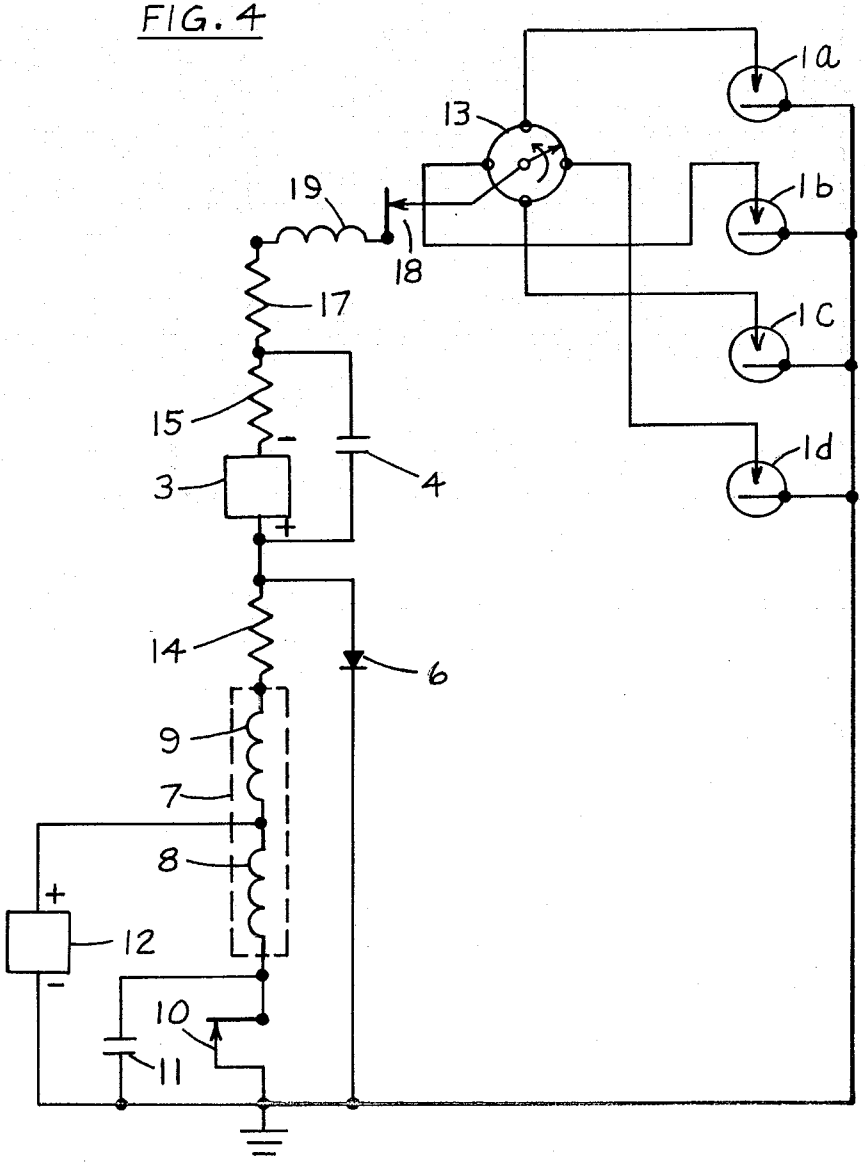
FIG. 4 shows a circuit diagram of the ignition system described in the present invention, and more particularly, an embodiment employing two coordinated generally series connected power sources and such that the series connected power sources are located in the series current loop in reverse order of that shown in FIG. 3, and such that the high voltage winding of the ignition coil is closer to ground potential than the high current power source.

FIG. 4 shows another preferred embodiment of the present invention as described generally under FIG. 5*b*, and in more detail under FIG. 2 which employs two coordinated series connected power sources, and where all elements are similar to the same numbered elements in FIGS. 5*b* and 2.

The only difference is that in FIG. 4, the two power sources, being series connected, have been reversed in their positions in the current loop, compared with their positions as described in FIG. 2, with the high current source consisting of elements 3, 4, 15, 17, 18 and 19 located close to the distributor, while the high voltage source is close to ground potential. The rectifier 6, in this case, bypasses the entire ignition coil 7.

It should be understood that of the various circuit elements combining to form the embodiments of the present invention, several elements have a return path to a common ground, which is typically the metal mass of an engine or the chassis of an automobile. These return paths are marked by the standard ground symbol on the figures, but are, for the sake of brevity, not described in detail in this specification, other than by this reference.

While preferred embodiments of the present invention have been described, various modifications and substitutions may be made within the scope and spirit thereof, by those skilled in the art.

I claim:

1. An ignition system with power boosting arrangement for an internal combustion engine, said engine having at least one cylinder with a combustion chamber with at least one spark plug having at least one spark gap, in which an initial spark is struck from a high voltage, low current source and then maintained as an arc from a coordinated high current, low voltage source at a high energy level for an extended duration, the improvement comprising:

a high voltage ignition coil having primary and a secondary high voltage winding disposed on a magnetic core, said windings having a turns ratio such as to create in said secondary winding an electrical pulse of short duration and a potential sufficient to strike a spark in said spark gap at the time of interruption of energizing current in said primary winding, a power source for high direct current of a voltage lower than that required to initiate a spark in said spark gap, but sufficiently high to sustain an arc across said spark gap at a predetermined high current value and for a predetermined duration once an initial spark has been struck, said power source consisting of a storage capacitor in parallel connection with a direct current power supply through a first current limiting resistor, said storage capacitor connected to said spark plug through a second limiting resistor and a first rectifier, said direct current power supply having such current and voltage rating as required to recharge said storage capacitor after each discharge before next discharge, high voltage ignition coil primary winding energizing current means and means for abruptly interrupting said energizing current at the instant an initial spark is to be struck, circuit means for connecting said high voltage secondary winding to said spark plug in parallel connection with said high current source through a second rectifier, said first and second rectifiers providing separation between said high voltage secondary winding and said high current power source, circuit means providing a common ground return path for said high voltage ignition coil, said high current power source and said spark plugs.

2. An ignition system with power boosting arrangement for an internal combustion engine having at least one cylinder with a combustion chamber with at least one spark plug having at least one spark gap in which an initial spark is struck from a high voltage, low current source and then maintained as an arc from a coordinated high current, low voltage source at a high energy level for an extended duration, the improvement comprising:

a high voltage ignition coil having a primary and a secondary high voltage winding disposed concentrically on a magnetic core, said windings having a turns ratio such as to create in said secondary winding an electrical pulse of short duration and a potential sufficient to strike a spark in said spark gap at the time of interruption of energizing current in said primary winding, a power source for high direct current of a voltage lower than that required to initiate a spark in said spark gap, but sufficiently high to sustain an arc across said spark gap at a predetermined high current value and for a predetermined duration, once an initial spark has been struck, said power source consisting of a storage capacitor in parallel connection with a direct current power supply through a first current limiting resistor, said storage capacitor connected through a second limiting resistor to one terminal of said secondary high voltage winding, the other terminal of said secondary winding connected to said spark plug and such that their polarities are mutually aiding, rectifier means in parallel connection with said secondary winding and connected in such direction as to provide a low impedance path from said high current source to said spark plug, high voltage ignition coil primary winding energizing current means and means for abruptly interrupting said energizing current in a timed relationship with said engine at the instant an initial spark is to be struck, circuit means providing a common ground return path for said high voltage ignition coil, said high current power source and said spark plug.

3. An ignition system with power boosting arrangement for an internal combustion engine having a plurality of cylinders, each cylinder having a combustion chamber each having at least one spark plug having at least one spark gap in which an initial spark is struck from a high voltage low current source and then maintained as an arc from a coordinated high current low voltage source at a high energy level for an extended duration, the improvement comprising:

a high voltage ignition coil having a primary and a secondary high voltage winding disposed on a magnetic core, said windings having a turns ratio such as to create in said secondary winding an electrical pulse of short duration and a potential sufficient to strike a spark in said spark gap at the time of interruption of energizing current in said primary winding, a power source for high direct current of a voltage lower than that required to initiate a spark in said spark gap, but sufficiently high to sustain an arc across said spark gap at a predetermined high current value and for a predetermined duration once an initial spark has been struck, said power source consisting of a storage capacitor in parallel connection with a direct current power supply through a first current limiting resistor, said storage capacitor connected to said spark plug through a second limiting resistor and a plurality of first rectifiers, said plurality being equal to the number of spark plugs, high voltage ignition coil primary winding energizing current means and means for abruptly interrupting said energizing current in timed relationship with said engine at the instant an initial spark is to be struck, a distributor having a rotary input contact and a number of output contacts equal to the number of cylinders, said distributor so constructed that it sequentially connects each subsequent high voltage pulse to each spark plug in the sequence required by the engine, circuit means for connecting said high voltage secondary winding to said distributor rotary input contact through a second rectifier, said first and second rectifiers providing separation between said high voltage secondary winding and said high current power source, circuit means for connecting each of said distributor output contacts to at least one spark plug in each combustion chamber, circuit means for connecting one terminal of each of said first rectifiers to one spark plug and for connecting the other terminal of all said first rectifiers to said second limiting resistor, circuit means providing a common ground return path for said high voltage ignition coil, said spark plugs and said power source for high current.

4. An ignition system with power boosting arrangement for an internal combustion engine having at least one cylinder, each cylinder having a combustion chamber each having at least one spark plug having at least one spark gap in which an initial spark is struck from a high voltage, low current source and then maintained as an arc from a coordinated high current, low voltage source at a high energy level for an extended duration, the improvement comprising:

a high voltage ignition coil having a primary and a secondary high voltage winding disposed on a magnetic core, said windings having a turns ratio such as to create in said secondary winding an electrical pulse of short duration and a potential sufficient to strike a spark in said spark gap at the time of interruption of energizing current in said primary winding, a power source for high direct current of a voltage lower than that required to initiate a spark in said spark gap, but sufficiently high to sustain an arc across said spark gap at a predetermined high current value and for a predetermined duration once an initial spark has been struck, said power source consisting of a storage capacitor in parallel connection with a direct current power supply through a first current limiting resistor, said storage capacitor connected through a second limiting resistor to one terminal of said secondary high voltage winding, the other terminal of said secondary winding connected to a distributor having a rotary input contact and a number of output contacts equal to the number of cylinders, said distributor so constructed that it sequentially connects each subsequent high voltage pulse to each spark plug in the sequence required by the engine, rectifier means in parallel connection with said secondary winding and connected in such direction as to provide a low impedance path from said high current source to said distributor rotary input contact, high voltage ignition coil primary winding energizing current means and means for abruptly interrupting said energizing current in a timed relationship with said engine at the instant an initial spark is to be struck, circuit means for connecting each of said distributor output contacts to at least one spark plug in each combustion chamber, circuit means providing a common ground return path for said high voltage ignition coil primary winding, said spark plugs and said power source for high current.

5. An ignition system with power boosting arrangement for an internal combustion engine having at least one cylinder, each cylinder having a combustion chamber each having at least one spark plug having at least one spark gap in which an initial spark is struck from a high voltage, low current source and then maintained as an arc from a coordinated high current, low voltage source at a high energy level for an extended duration, the improvement comprising:

a high voltage ignition coil having a primary and a secondary high voltage winding disposed on a magnetic core, said windings having a turns ratio such as to create in said secondary winding an electrical pulse of short duration and a potential sufficient to strike a spark in said spark gap at the time of interruption of energizing current in said primary winding, a power source for high direct current of a voltage lower than that required to initiate a spark in said spark gap, but sufficiently high to sustain an arc across said spark gap at a predetermined high current value and for a predetermined duration once an initial spark has been struck, said power source consisting of a storage capacitor in parallel connection with a direct current power supply through a first current limiting resistor, said storage capacitor connected through a second limiting resistor to one terminal of said secondary high voltage winding, the other terminal of said secondary winding connected to a distributor having a rotary input contact and a number of output contacts equal to the number of cylinders, said distributor so constructed that it sequentially connects each subsequent high voltage pulse to each spark plug in the sequence required by the engine, rectifier means comprising a plurality of rectifiers, said plurality equal to the number of spark plugs, with one terminal of each of said rectifiers connected to a spark plug and the other terminals of said rectifier jointly connected to said second limiting resistor, and such that each rectifier provides a low impedance path from each spark plug to said second limiting resistor, circuit means providing a common ground return path for said high voltage ignition coil primary winding, said spark plugs and said power source for high current, high voltage ignition coil primary winding energizing current means and means for abruptly interrupting said energizing current in a timed relationship with said engine at the instant an initial spark is to be struck, circuit means for connecting each of said distributor output contacts to at least one spark plug in each combustion chamber.

6. An ignition system as defined in claim 1, 2, 3, 4 or 5, further comprising in series with said second limiting resistor a resonating inductor such that said inductor, coacting with said storage capacitor, causes said capacitor to discharge through said spark gap in a generally sinusoidal halfwave current.

7. An ignition system as defined in claim 1, 2, 3, 4 or 5, further comprising in series connection with said second limiting resistor a resonating inductor such that said inductor, coacting with said storage capacitor, causes said capacitor to discharge through said spark gap in a generally sinusoidal halfwave current, further comprising in series with said resonating inductor a current disconnect element controlled in timed relationship with said engine, such that the element closes the discharge path for said storage capacitor immediately prior to the instant the initial spark is struck, and again opens said path after the lapse of a time interval such that the duration of said arc has been sufficient to ensure complete combustion.

8. An ignition system as defined in claim 1, 2, 3, 4 or 5, further comprising in series connection with said second limiting resistor a current disconnect element controlled in timed relationship with said engine such that the element closes the discharge path for said storage capacitor immediately prior to the instant the spark is struck and again opened after the lapse of a time interval such that the duration of said arc has been sufficient to ensure complete combustion.

* * * * *